US009821177B2

(12) United States Patent
Vogels

(10) Patent No.: US 9,821,177 B2
(45) Date of Patent: Nov. 21, 2017

(54) RUNNER FOR GUIDANCE ALONG A GUIDE CABLE OF AN ANCHORING DEVICE

(71) Applicant: XSPLATFORMS B.V., Gorinchem (NL)

(72) Inventor: Matthijs Vogels, Rotterdam (NL)

(73) Assignee: XSPLATFORMS B.V., Gorinchem (NL)

( * ) Notice: Subject to any disclaimer, the term of this patent is extended or adjusted under 35 U.S.C. 154(b) by 0 days.

(21) Appl. No.: 14/362,379

(22) PCT Filed: Dec. 3, 2012

(86) PCT No.: PCT/NL2012/050852
§ 371 (c)(1),
(2) Date: Jun. 2, 2014

(87) PCT Pub. No.: WO2013/081464
PCT Pub. Date: Jun. 6, 2013

(65) Prior Publication Data

US 2014/0318890 A1 Oct. 30, 2014

(30) Foreign Application Priority Data

Dec. 2, 2011 (NL) ..... 1039209

(51) Int. Cl.
*A62B 35/00* (2006.01)
*A62B 5/00* (2006.01)

(52) U.S. Cl.
CPC ..... *A62B 35/0087* (2013.01); *A62B 5/00* (2013.01); *A62B 35/0056* (2013.01); *A62B 35/0081* (2013.01)

(58) Field of Classification Search
CPC . A62B 35/00; A62B 35/0043; A62B 35/0037; A62B 35/005; A62B 35/0056; A62B 35/0068; A62B 35/0081; A62B 35/0087; E04G 21/3295; E04G 21/3261; A63B 7/00; A63B 7/04
See application file for complete search history.

(56) References Cited

U.S. PATENT DOCUMENTS 4,790,410 A * 12/1988 Sharp ..... A62B 35/0056 182/12
5,224,427 A * 7/1993 Riches ..... A62B 35/0056 104/115

(Continued)

*Primary Examiner* — Daniel Cahn
*Assistant Examiner* — Shiref Mekhaeil
(74) *Attorney, Agent, or Firm* — Luoh J. Wu; Continent Patent Office LLP

(57) ABSTRACT

A runner 7 has a housing 21 with two runner wheels 23 attached to the housing. The housing includes a sleeve 25 that can freely turn around the longitudinal axis 27 in a channel 29 present in the housing. The sleeve constitutes an elongated guide opening by which the runner can be moved over the guide cable.
Longitudinal slots extending in axial direction are present in the walls 21A, 25A of the channel 29 and of the sleeve 25. Each slot has a middle section 31A, 33A.
The width 34 of the middle section 33A of the longitudinal slot in the sleeve is smaller than the width 32 of the middle section 31A of the longitudinal slot in the housing, and, furthermore, the width 34 of the middle section 33A of the slot 33 in the sleeve is smaller than the diameter of the guide cable 3 the runner 7 is suitable for.

4 Claims, 2 Drawing Sheets

(56) References Cited

U.S. PATENT DOCUMENTS 5,279,385 A * 1/1994 Riches ..... A62B 35/0087 182/3
6,474,442 B1 * 11/2002 Atkinson ..... A62B 1/14 104/115
7,347,300 B2 * 3/2008 Renton ..... A62B 35/0087 182/3
8,001,904 B2 * 8/2011 Maes ..... A62B 35/0056 104/112
8,499,896 B2 * 8/2013 Midtgaard ..... E04G 3/32 182/141
2002/0050421 A1 * 5/2002 Lara ..... A62B 35/0056 182/36
2003/0029672 A1 * 2/2003 Argoud ..... A62B 35/0056 182/36
2003/0111293 A1 * 6/2003 Desjardins ..... A62B 35/0056 182/36
2003/0140562 A1 * 7/2003 Staser ..... E05F 11/382 49/352
2006/0054386 A1 * 3/2006 Blackford ..... A62B 1/04 182/3
2006/0124391 A1 * 6/2006 Jones ..... A62B 35/0056 182/36
2007/0119653 A1 * 5/2007 Brown ..... A62B 1/14 182/36
2007/0261915 A1 * 11/2007 Auston ..... A62B 35/0056 182/11
2011/0239898 A1 * 10/2011 Brown ..... A63G 21/20 105/150
2011/0297480 A1 * 12/2011 Jones ..... A62B 35/0081 182/36
2012/0073901 A1 * 3/2012 Virus-Tetzlaff ..... A62B 35/00 182/3
2013/0180801 A1 * 7/2013 Vogels ..... E04G 7/34 182/113
2014/0027583 A1 * 1/2014 Vogel ..... A62B 35/0068 248/68.1
2015/0014092 A1 * 1/2015 Blaise ..... A62B 35/0043 182/5
2015/0059611 A1 * 3/2015 Brown ..... B61H 1/00 104/113
2015/0083016 A1 * 3/2015 Fessler ..... B61B 12/02 104/112

* cited by examiner

RUNNER FOR GUIDANCE ALONG A GUIDE CABLE OF AN ANCHORING DEVICE

FIELD OF THE INVENTION

The invention relates to a runner which can be moved over a guide cable, where supporting brackets are fixed to the guide cable by which the guide cable is fixed to a wall or ceiling or to a roof structure of a building, which runner comprises a housing that is provided with a channel which accommodates a sleeve rotatable around the longitudinal axis through which sleeve the guide cable extends during operation, the walls of the channel and of the sleeve being each provided with a longitudinal slot extending in axial direction from one end to the other end of the wall, which longitudinal slot has a middle section, and which housing is provided with a fastening eyelet for a person's fall protection line.

The longitudinal slots are necessary for allowing the runner to slide past a supporting bracket by which the guide cable is fixed to the wall or ceiling or to the roof structure. The runner then passes by the supporting bracket with the aid of the longitudinal slots.

STATE OF THE ART

A runner of this type is known from GB 2 388 148 A. With this known runner the width of the longitudinal slot in the sleeve is as big as that of the longitudinal slot in the housing and exceeds the diameter of the guide cable, so that, if the two longitudinal slots are located side by side, the runner will allow of being fitted to the guide cable in a direction perpendicular to the guide cable. By subsequently turning the sleeve, the longitudinal slot in the sleeve ends up partly beside the wall of the channel in the housing so that the guide cable can no longer be passed through the free section of the longitudinal slot. To the sleeve is attached a radially extending eyelet which is concentric to the fastening eyelet when a fall protection line is secured to the runner, while the coupling hook of the fall protection line passes through the two eyelets so that the sleeve can no longer turn around the longitudinal axis inside the housing and the runner is locked on to the guide cable.

Since the sleeve is then no longer capable of turning, when a supporting bracket is passed, the runner is to be kept in the position where the open section of the longitudinal slot in the sleeve can be moved over the supporting bracket. This is difficult if the fall protection line also keeps the runner at an angle when said open section is not located in the place of the supporting bracket. When a supporting bracket is passed, the fall protection line with its end attached to the runner is to be kept in the position where the open section is located beside the supporting bracket.

SUMMARY OF THE INVENTION

It is an object of the invention to provide a runner of the type defined in the opening paragraph where the position of the runner relative to a supporting bracket is less critical for passing the supporting bracket and without a hazard arising that the runner becomes detached from the guide cable. For this purpose the runner according to the invention is characterized in that the width of the middle section of the longitudinal slot in the sleeve is smaller than the width of the middle section of the longitudinal slot in the housing, while during operation when the runner is present around a guide cable and a fall protection line is coupled to the fastening eyelet, the sleeve which is freely rotatable around the longitudinal axis is present in the channel, and the width of the middle section of the slot in the sleeve is smaller than the diameter of the guide cable this runner is suitable for. When a supporting bracket is passed, this supporting bracket will not strike against the end of the sleeve if the housing is located at an angle to the vertical, but against the wall of the longitudinal slot. Since the longitudinal slot in the sleeve widens towards the ends, the wall will show an oblique pattern so that the supporting bracket pushes against this wall and turns the sleeve inside the housing.

Preferably the longitudinal slot in the sleeve widens towards the ends where, seen in side elevation of the sleeve, the longitudinal slot at the ends extends at an angle of at least 90 degrees relative to the wall. If the runner passes a supporting bracket in a position at an angle to the vertical, the supporting bracket comes into contact with one of the tapered walls of the slot so that the sleeve will turn. This angle preferably extends at an angle of at least 180 degrees.

An embodiment of the runner according to the invention is characterized in that the wall of the sleeve or of the channel has a transverse slot that extends transversely to the longitudinal slot and a protuberance is located on the inside of the wall of the channel in the housing or on the outside of the wall of the sleeve, which protuberance sticks into the transverse slot, while the ends of the transverse slot constitute stops that limit the turning of the sleeve around the longitudinal axis. The transverse slot preferably extends over an angle that is such that the longitudinal slot in the sleeve is always present next to the longitudinal slot in the housing. Therefore, the preferred maximum angle is 80 degrees.

The invention likewise relates to an anchoring device comprising a guide cable to which supporting brackets can be fixed for anchoring the guide cable to a wall or ceiling or to a roof structure of a building, as well as a runner which can run over a guide cable and to which a fall protection line can be attached. With respect to the anchoring device the invention is characterized in that the runner is a runner according to the invention for which the width of the middle section of the longitudinal slot in the sleeve is smaller than the diameter of the guide cable. As a result, the runner can be slid onto and from the guide cable only at an end of the guide cable.

An embodiment of the anchoring device according to the invention is characterized in that the anchoring device further includes a coupling member via which the runner can be slid onto the guide cable and which is attached to an end of the guide cable and can be fixed to a wall or to a roof structure of the building, which coupling member comprises two parallel arms of which one arm is shorter than the other and between which an end part of the guide cable is located, where this end part runs parallel to the arms and where the ends of the arms are fixed to the guide cable by means of a bridge element each, which bridge elements are designed such that the runner can be slid over the bridge elements with the longitudinal slot and where the distance between the bridge elements exceeds the dimension of the runner measured in the direction of the guide cable so that the runner can be turned around the guide cable between the two bridge elements. Since the runner can be slid onto and from the guide cable only at an end of the guide cable, the anchoring device includes a coupling member. For being in a position to be slid from the guide cable, the runner is first to be turned upwards through a 180 degree angle, then slid onto the longer arm past the bridge element and then turned backwards and be slid onto the shorter arm past the bridge element. In consequence, in this construction the runner cannot leave the guide cable by accident.

BRIEF DESCRIPTION OF THE DRAWINGS

The invention will be described in more detail hereinbelow based on an example of embodiment of the anchoring device according to the invention while reference is made to the appended drawing figures, in which.

DETAILED DESCRIPTION OF THE DRAWINGS

Figure 1:
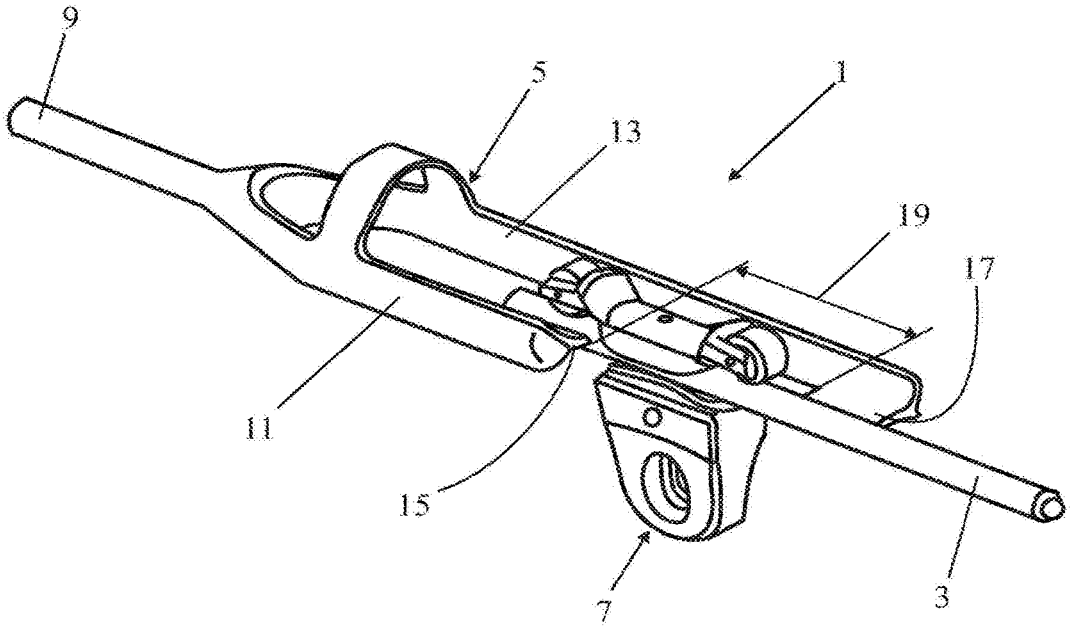
FIG. 1 shows the anchoring device in the place of a coupling member.

FIG. 1 shows an embodiment of the anchoring device according to the invention in the place of a coupling member. The anchoring device 1 comprises a guide cable 3 to which are connected supporting brackets (see FIG. 3) by which the guide cable is fixed to a wall of a building, as well as a coupling member 5 via which a runner 7 can be slid onto the guide cable.

Figure 2:
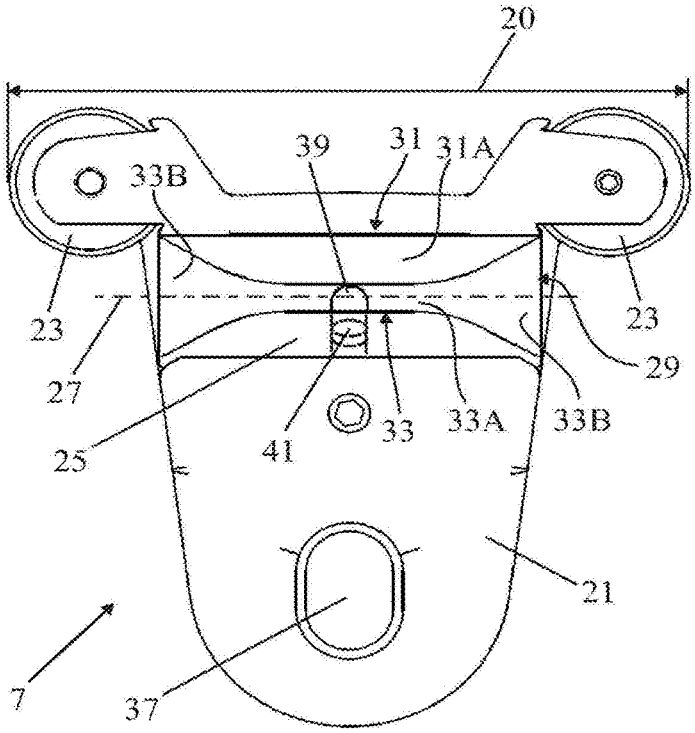
FIG. 2 shows a front elevation of the runner.

The coupling member 5 is attached to an end of the guide cable 3 and fitted with an end 9 to a wall. The coupling member comprises two parallel arms 11 and 13, one of which is shorter than the other. Between the arms and parallel to the arms is present an end part of the guide cable 3. The arms are each fixed with an end to the guide cable 3 by means of a bridge element 15, 17. The distance 19 between the bridge elements exceeds the dimension 20 (see FIG. 2) of the runner 7 measured in the direction of the guide cable, so that the runner can be turned around the guide cable between the two bridge elements.

The runner 7 (see FIG. 2) has a housing 21 with two runner wheels 23 attached to this housing. The housing includes a sleeve 25 which can freely turn around the longitudinal axis 27 in a channel 29 present in the housing. The sleeve 25 forms an elongated guide opening through which the runner can be slid over the guide cable. Longitudinal slots 31 and 33 are present in the walls 21A and 25A of the channel 29 and of the sleeve 25, which longitudinal slots extend in axial direction from one end to the other end of the walls.

Each slot has a middle section 31A, 33A. The width 34 of the middle section 33A of the longitudinal slot in the sleeve is smaller than the width 32 of the middle section 31A of the longitudinal slot in the housing (see FIG. 3). Furthermore, the width 34 of the middle section 33A of the slot 33 in the sleeve is smaller than the diameter of the guide cable 3 the runner 7 is suitable for.

The longitudinal slot 33 in the sleeve widens towards the ends 33B while the end of the longitudinal slot extends at a 180 degree angle 35.

The housing 21 is further provided with a fastening eyelet 37 to which a person's fall protection line can be attached.

The wall of the sleeve 25 has a transverse slot 39 that extends transversely to the longitudinal slot 33. A protuberance 41 projecting into the transverse slot is present on the inside of the wall 21A of the channel in the housing. The ends 43 of the transverse slot constitute stops that limit the turning of the sleeve around the longitudinal axis. The transverse slot 39 hereby extends at a 90 degree angle 36. The outermost positions of the transverse slot 33 in the sleeve are indicated by broken lines.

Figure 3:
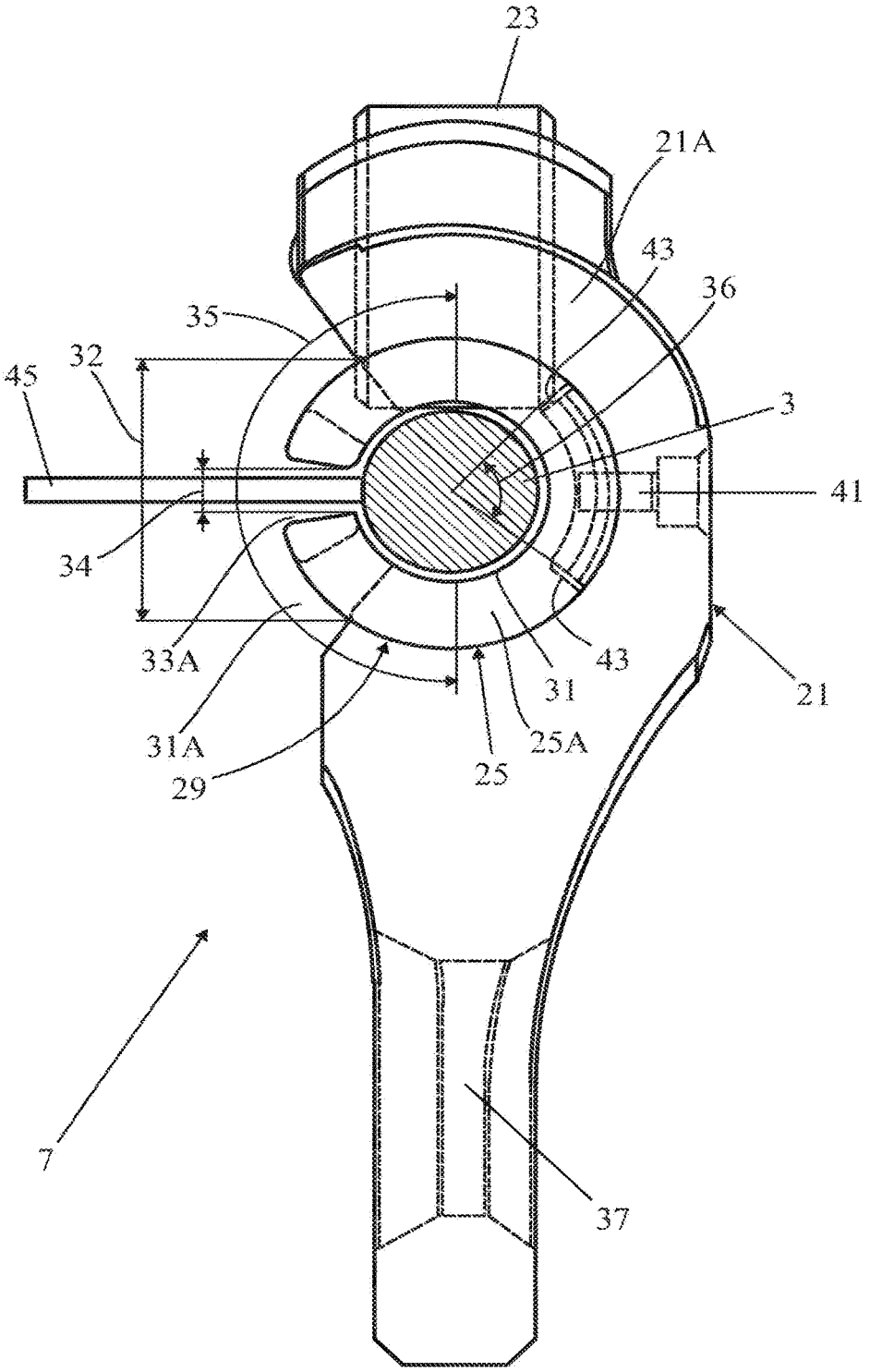
FIG. 3 shows a side elevation of the runner while a supporting bracket is being passed.

FIG. 3 likewise shows a supporting bracket 45 by which the guide cable 3 can be fixed to a wall.

Albeit the invention described above has been described in the foregoing with reference to the drawing figures, it should be established that the invention is not by any manner or means restricted to the embodiments shown in these drawing figures. The scope of the invention is also extended to any embodiments deviating from the embodiments shown in the drawing figures within the scope of the claims.

What is claimed is:

1. A runner which can be moved over a guide cable, said guide cable having a diameter which is the same over a length of the guide cable, where supporting brackets are fixed to the guide cable by which the guide cable is fixed to a wall or ceiling or to a roof structure of a building, the runner comprising:

a housing that is provided with a channel, said channel accommodates a sleeve rotatable relative to the housing around a longitudinal axis of the sleeve, through said sleeve the guide cable extends during operation, a wall of the channel being provided with a longitudinal slot extending from an end to another end of the wall of the channel and configured to be parallel to the guide cable, said longitudinal slot in the wall of the channel has a middle section, and a wall of the sleeve being provided with a linear longitudinal slot extending from an end to another end of the wall of the sleeve along substantially the entire major length of the sleeve, and configured to be parallel to the guide cable, said linear longitudinal slot in the sleeve has a middle section, and said housing is provided with a fastening eyelet for a person's fall protection line, wherein a width of the linear longitudinal slot in the sleeve at the middle section of said linear longitudinal slot in the sleeve is smaller than a width of the longitudinal slot in the wall of the channel at the middle section of said longitudinal slot in the channel in the housing, while during operation when the runner is present around the guide cable and said fall protection line is coupled to the fastening eyelet, the sleeve which is freely rotatable relative to the housing around the longitudinal axis is present in the channel, and the width of the linear longitudinal slot in the sleeve at the middle section of the linear longitudinal slot in the sleeve is smaller than the diameter of the guide cable suited for said runner.

2. The runner of claim 1, wherein the linear longitudinal slot in the sleeve widens towards the ends of the sleeve.

3. The runner of claim 1, wherein the wall of the sleeve has a transverse slot that extends in an outer surface of the wall of the sleeve in a circumferential direction of the wall of the sleeve and transversely to the linear longitudinal slot in the sleeve, and a protuberance is fixed to the housing and is located on an inside of the wall of the channel in the housing, said protuberance sticks into the transverse slot, while ends of the transverse slot constitute stops that are configured to limit rotation of the sleeve around the longitudinal axis.

4. An anchoring device comprising: a guide cable which can be fixed to supporting brackets for anchoring the guide cable to a wall or ceiling or to a roof structure of a building, and a runner which can run over the guide cable and can be attached to a fall protection line, wherein the runner comprises:

a housing that is provided with a channel, said channel accommodates a sleeve rotatable relative to the housing around a longitudinal axis of the sleeve, through said sleeve the guide cable extends during operation, a wall of the channel being provided with a longitudinal slot extending from an end to another end of the wall of the channel and the sleeve being provided with a linear longitudinal slot extending from an end to another end of a wall of the sleeve along substantially the entire major length of the sleeve, said linear longitudinal slot in the sleeve has a middle section, and said housing is provided with a fastening eyelet for a person's fall protection line, wherein a width of the linear longitudinal slot in the sleeve at the middle section of said linear longitudinal slot in the sleeve is smaller than a width of the longitudinal slot in the wall of the channel at a middle section of said longitudinal slot in the wall of the channel, while during operation when the runner is present around the guide cable and said fall protection line is coupled to the fastening eyelet, the sleeve which is freely rotatable relative to the housing around said longitudinal axis is present in the channel, and the width of the linear longitudinal slot in the sleeve at the middle section of the linear longitudinal slot in the sleeve is smaller than a diameter of the guide cable suited for said runner.

* * * * *